US006032660A

United States Patent [19]

Hervig

[11] Patent Number: 6,032,660

[45] Date of Patent: Mar. 7, 2000

[54] BOW WITH MODIFIED BRAKING

[76] Inventor: Dana P. Hervig, 1450 102nd St. E., Inver Grove Heights, Minn. 55077

[21] Appl. No.: 09/276,809

[22] Filed: Mar. 25, 1999

Related U.S. Application Data

[63] Continuation-in-part of application No. 08/933,221, Sep. 18, 1997.

[51] Int. Cl.[7] ..... F41B 5/10

[52] U.S. Cl. ..... 124/25.6; 124/900

[58] Field of Search ..... 124/23.1, 25.6, 124/900; 188/24.21

[56] References Cited

U.S. PATENT DOCUMENTS

| | | | |
|---|---|---|---|
| 3,878,920 | 4/1975 | Fujii | 188/24.21 |
| 4,246,883 | 1/1981 | Ash | 124/25.6 |
| 4,294,221 | 10/1981 | Bryant | 124/25.6 |
| 4,471,747 | 9/1984 | Nishioka | 124/23.1 |
| 4,757,799 | 7/1988 | Bozek | 124/25.6 |
| 4,886,039 | 12/1989 | Wagner | 124/25.6 |
| 5,000,154 | 3/1991 | Slayton | 124/23.1 |
| 5,002,035 | 3/1991 | Brooks | 124/23.1 |
| 5,092,309 | 3/1992 | Beaton | 124/25.6 X |
| 5,146,908 | 9/1992 | Larson | 124/25.6 X |
| 5,465,705 | 11/1995 | Baeseman | 124/88 |

*Primary Examiner*—John A. Ricci

[57] ABSTRACT

A bow with modified braking uses flexible bow limbs attached above and below a bow handle. The bow limbs have wheels that guide a bow string and form pulleys. The pulleys mechanically assist in holding the bow limbs when the bow string is drawn. A remotely controlled brake operated by a brake lever near the bow handle is used to limit bow wheel motion to reduce the difficulty of holding a drawn bow string. The remotely controlled brake has spring held brake contactors capable of elastic extension and retraction in the directions of bow wheel rotation that engage with a braking surface located on the bow wheel. The modified brake requires an archer to hold some of the pressure of a drawn bow string to prevent the bow wheel from extending the brake contactors which would release the bow string.

16 Claims, 3 Drawing Sheets

BOW WITH MODIFIED BRAKING

TECHNICAL FIELD

The present application is a continuation-in-part of U.S. patent application Ser. No. 08/933,221, filed Sep. 18, 1997. This invention relates to brake assistance modifications for a conventional compound archery bow using Hervig's principle of limiting the drawn holding weight of a compound bow by the mechanical engagement of a bow brake with a brake surface on a bow pulley wheel, a connected bow wheel axis attachment, or a bow string.

BACKGROUND OF THE INVENTION

Currently, many states in the U.S. allow compound archery bows which use pulleys to mechanically assist in reducing effort required to hold a drawn bow string. Generally, most states will not let a hunter use a bow that holds a bowstring back by means of a locking device, unless the hunter is handicapped. The present invention is made to fit the catagory of bows whose strings are held by mechanical assistance vs. those whose strings are mechanically held such as the crossbow.

A bow with modified braking uses a brake surface consisting of teeth on a bow wheel or cam that can interlock with similar teeth positioned on a pair of spring seperated brake calipers. Each caliper has a brake contacter consisting of a rack of sliding caliper teeth which is able to slide in a linear path for extension and retraction inside a caliper track. The contactor on each caliper is connected to the caliper track with a track spring. From the bowstrings fully drawn position, the contacters can hold onto the bow wheel teeth and allow up to about a half inch of movement in the direction of bow wheel rotation before the track springs stretch enough to let the bow wheel teeth exit the linear track path and rotate freely in the approximately circular bow wheel path to release the bow string.

The strength of track springs that hold the contactors inside the caliper tracks will determine the amount of archer strength required to hold the bow string drawn after the brake is engaged.

An example of the how the modified brake works is as follows: When the bowstring is at full draw the contactors are remotely engaged from the brake lever via the brake cable with the bow wheel teeth. On a bow that requires 20 lbs. of force to hold the string drawn without the brake, a 9 lb. rated spring would be used on each of the two caliper tracks. This would mean that 18 lbs. of track spring pressure would be working against the 20 lbs. of force applied by the bow limbs to the bow string. Thus, the archer would have to hold approximately 2 lbs. against the string to prevent the bow from firing. If less than 2 lbs. of force were applied by the archer in the preceeding example, the bow wheel teeth would extend the track springs and continue on an approximately circular path to let the bow string release. Following bow string release the extended contactors would retract to their normal positions inside the caliper tracks.

The embodiment shown uses a brake lever on the bow handle to actuate the brake by the archers fingers once the bow string is drawn. Releasing the brake lever returns the tension held by the modified brake to the arms of the archer. By applying stopping power to the bows string, cables, or wheels (pulley system) with a brake, the bow string can be held back with less fatigue.

The described bow would be drawn and held by the archers own strength at all times. One hand would always be on the bow string and the other hand would always be on the bow handle throughout the draw, hold, and release.

The drawing and releasing of the bow string would be performed the same as a conventional compound bow.

SUMMARY OF THE INVENTION

In addition to the reduction in effort required to hold back a bow string provided by the pulleys of a conventional compound bow, the present invention allows a further reduction in muscular effort to hold back a drawn bow string. The invention is based on the principle that; applying resistance to the movement of a compound bow's string or wheel/cam when the bow string is drawn will cause the bow's limbs to remain in a flexed position.

The bow with modified braking that forms the basis of the present invention comprises in general, a conventional compound bow having a braking surface that is engageable with a brake having a brake contactor capable of spring controlled elastic extension and retraction in the directions of bow wheel or cam rotation to engage with the braking surface for limiting bow pulley and string movement after the bow string is pulled to full draw. The brake modification reduces required archer effort to hold a drawn bow string, and ensures the string will release if the archer lets go of it.

BRIEF DESCRIPTION OF THE DRAWINGS

The invention will be better understood, and objects other than those set forth above will become apparent when consideration is given to the following detailed description thereof. Such description makes reference to the drawings wherein.

DETAILED DESCRIPTION OF THE INVENTION

Figure 1:
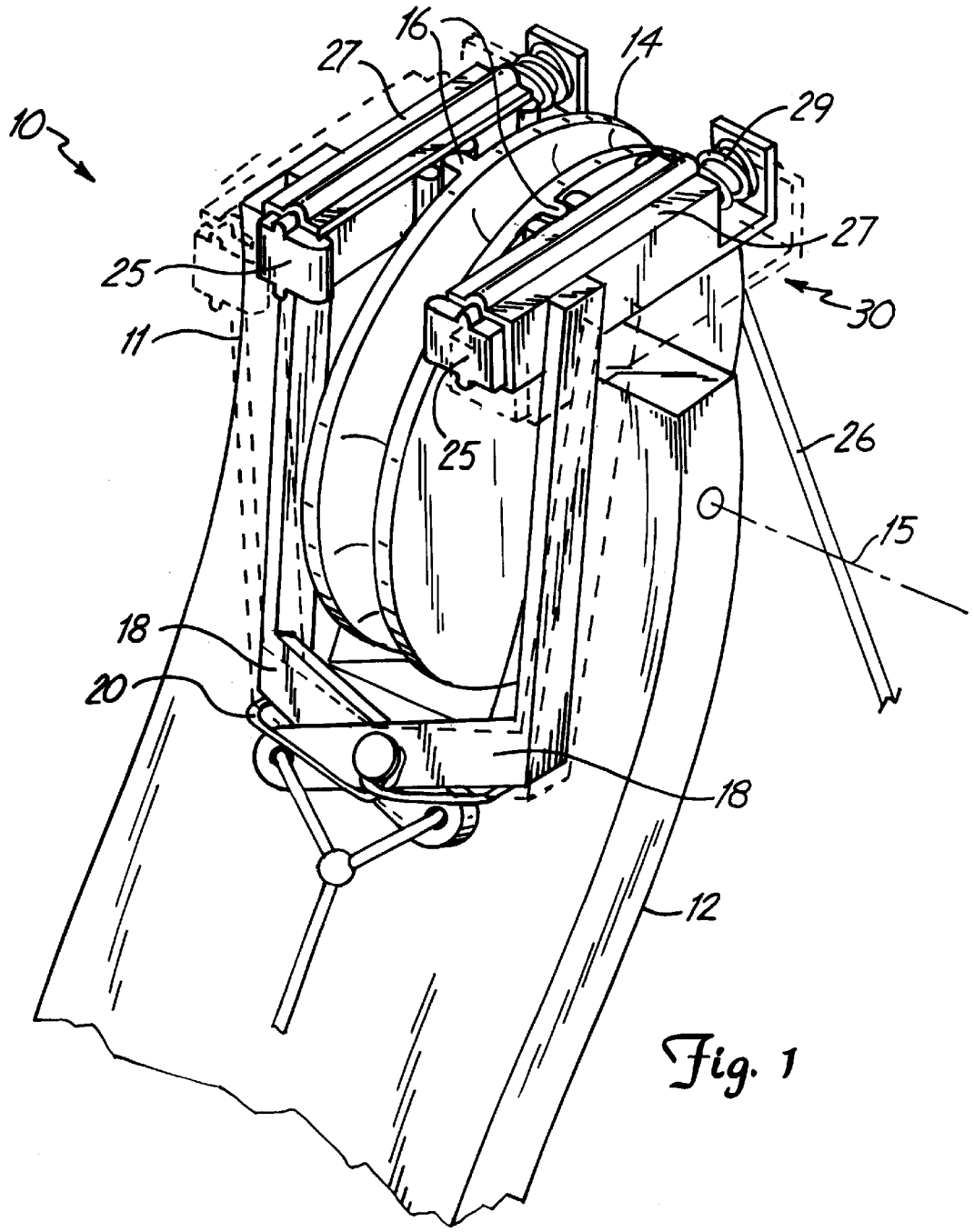
FIG. 1 is a perspective view of a bow modified braking.

The preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

Figure 2:
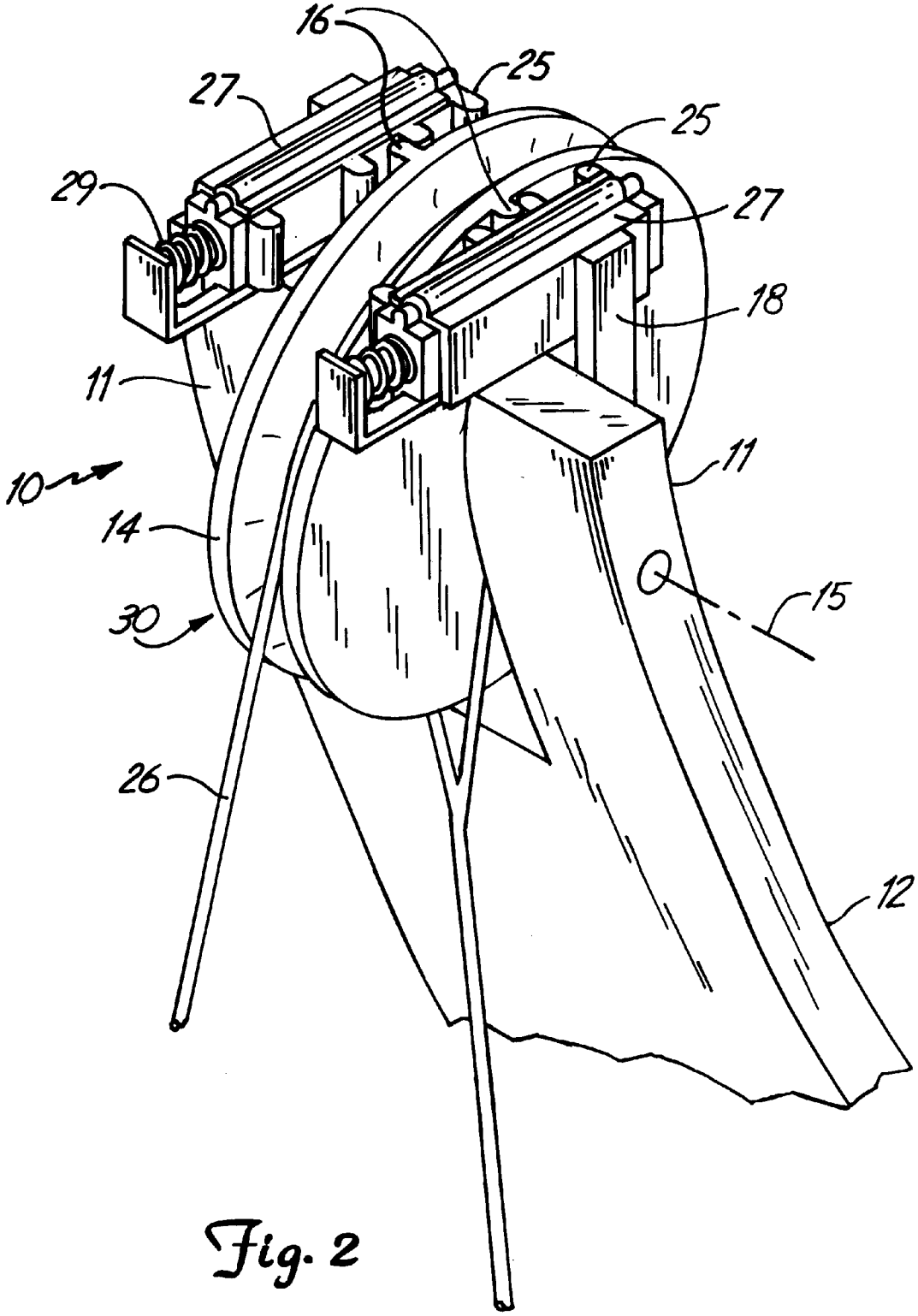
FIG. 2 is a perspective view of the present invention.
Figure 3:
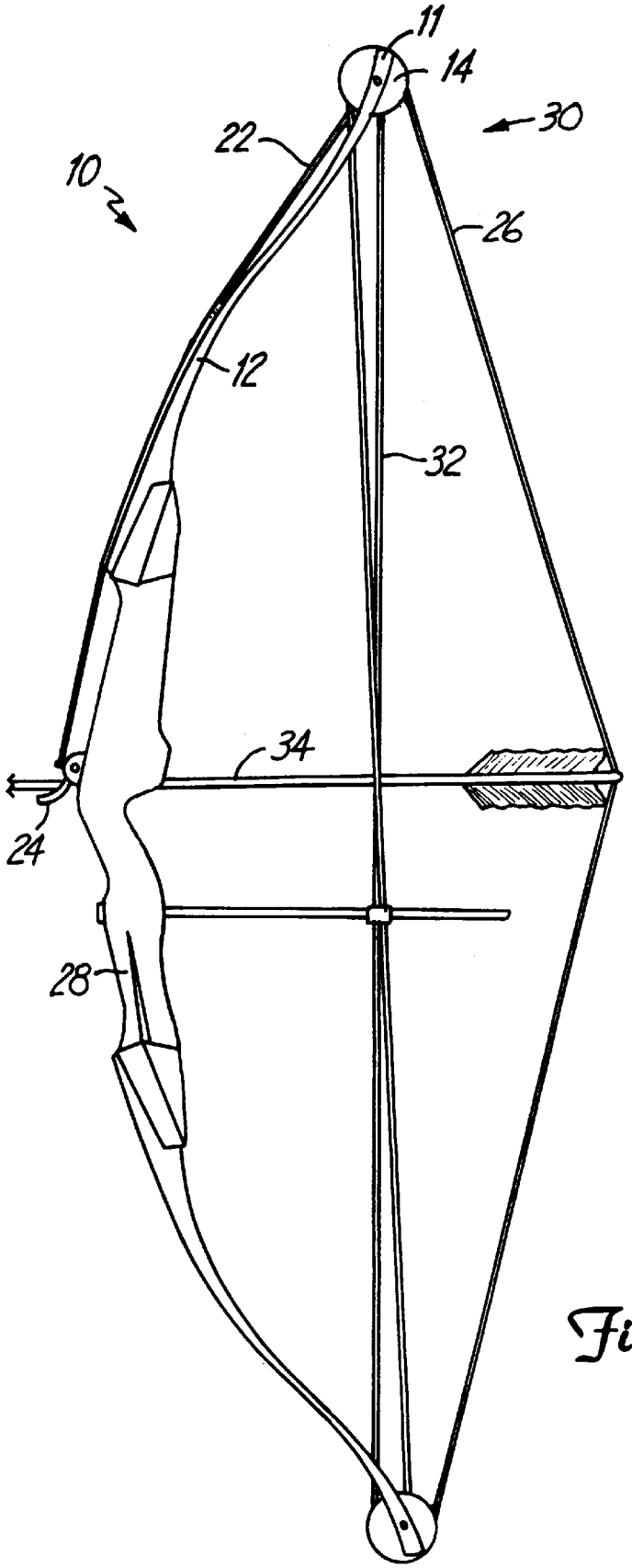
FIG. 3 is a side plan view of a bow according to principles of the present invention.

Referring now to FIGS. 1–3, the reference numeral 10, generally designates an embodiment of the bow with modified braking according to the present invention. The bow 10 includes flexible bow limbs 12 attached above and below bow handle 28. Bow limbs 12 have split tips 11 that allow a grooved bow wheel or cam 14 to rotate about wheel axis 15. The bow wheel 14 guides bow string 26 and forms pulley 30. Pulley 30 compresses bow limb 12 when bow string 26 and arrow 32 are drawn back. Two brake calipers 18 squeeze together via brake cable 22 when brake trigger lever 24 positioned on bow handle 28 is squeezed by an archer's finger (not shown).

Brake calipers 18 are seperated by brake spring 20 and include racks of sliding teeth called brake contactors 25 that can releasably engage brake surface teeth 16 on the bow wheel/cam 14. Each brake contactor 25 is capable of flexible extension and retraction in a linear path inside a caliper track 27 via a track spring 29. From the bowstring's 26 fully drawn position, contactors 25 can hold onto bow wheel teeth 16 and allow about a half inch of movement in the direction of rotation of bow wheel 14 before track springs 29 stretch to let bow wheel teeth 16 exit contactors 25 by rotation away from the linear path into the approximately circular bow wheel path to release bow string 26.

Holding brake surface 16 consequently stops the motion of pulley 30 and holds the limbs 12 of bow 10 in a compressed position. Both track springs 29 and brake spring 20 cause brake 18 to release pressure against brake surface 16 and require an archer to hold bow string 26 at full draw to prevent rotation of wheel 14 about wheel axis 15.

While the invention has been described in conjunction with a specific embodiment thereof, it is evident that different alternatives, modifications, variations, and uses will be apparent to those skilled in the art, in view of the foregoing description. Accordingly, the invention is not limited to these embodiments or the use of elements having specific configurations and shapes as presented herein.

What is claimed is:

1. A bow comprising;

a) bow limbs attached above and below a bow handle;

b) bow wheels or cams each rotatably mounted about a wheel axis;

c) said bow limbs providing attachment for said bow wheels or cams;

d) braking surface upon which contact thereof causes resistance to rotation of one of the bow wheels or cams about said wheel axis;

e) bow string which, when drawn, causes compression of the bow limbs by application of tension across said bow wheels or cams; and f) remotely controlled brake capable of elastic extension and retraction in the directions of bow wheel or cam rotation; said brake being engageable with the braking surface whereby an archer may selectively engage or disengage the brake with the braking surface.

2. The bow of claim 1, wherein said brake has a contactor comprised of a rack of sliding teeth with a spring connection to hold said contacter in a track contained by the brake.

3. A bow according to claim 1, wherein the braking surface is provided on one of the bow wheels or cams.

4. A bow according to claim 1, wherein the braking surface is rotatably connected to one of the bow wheels or cams.

5. A bow according to claim 1, wherein the braking surface is mounted along the same axis as one of the bow wheels or cams.

6. A bow comprising;

a) bow limbs attached above and below a bow handle;

b) bow wheels or cams each rotatably mounted about a wheel axis;

c) bow string which, when drawn, causes compression of the bow limbs by application of tension across said bow wheels or cams; and d) remotely controlled brake capable of releasably coupling with a braking surface on the bow wheel or cam to elastically limit bow wheel or cam rotation; said brake being engageable with said braking surface whereby an archer may selectively engage or disengage the brake with the braking surface.

7. The bow of claim 6, wherein said brake has a track that guides a tooth with a spring connection between said track and said tooth to limit the tooth movement to a predetermined extent.

8. A bow according to claim 6, wherein said braking surface is comprised of a tooth surface provided on one of the bow wheels or cams.

9. A bow according to claim 6, wherein said braking surface is rotatably connected to one of the bow wheels or cams.

10. A bow according to claim 6, wherein said braking surface is mounted along the same axis as one of the bow wheels or cams.

11. The bow of claim 6, wherein said brake has a caliper that is separated from the bow wheel or cam by a brake spring.

12. The bow of claim 6, wherein said brake is remotely activated from a brake lever on a bow handle via a brake cable.

13. The bow of claim 6, wherein said brake is capable of allowing elastic seperation from said braking surface to release said bow string when the brake is selectively engaged with the braking surface.

14. A remotely controlled bow brake; said brake capable of releasable interlocking engagement with a braking surface on a bow wheel or cam to limit said bow wheel or cam rotation; the brake being engageable with said braking surface whereby an archer may selectively engage or disengage the brake with the braking surface; wherein the brake is capable of allowing elastic release from the braking surface to release the bow wheel or cam when the brake is selectively engaged with the braking surface.

15. The bow brake of claim 14 wherein said brake is adaptable for remote activation from a bow handle brake lever via a brake cable.

16. The bow brake of claim 14, wherein said brake has a track that guides a tooth with a spring connection between said track and said tooth to limit the tooth movement to a predetermined extent.

* * * * *